US009611839B2

(12) United States Patent
McNulty et al.

(10) Patent No.: US 9,611,839 B2
(45) Date of Patent: Apr. 4, 2017

(54) LOW RESIDUAL INVERTED PUMPS, DISPENSERS AND REFILL UNITS

(71) Applicant: GOJO Industries, Inc., Akron, OH (US)

(72) Inventors: John J. McNulty, Broadview Heights, OH (US); Robert L. Quinlan, Stow, OH (US); Nick E. Ciavarella, Seven Hills, OH (US); Carrie Anne Zapka, Austintown, OH (US); David J. Shumaker, Bay Village, OH (US)

(73) Assignee: GOJO Industries, Inc., Akron, OH (US)

( * ) Notice: Subject to any disclaimer, the term of this patent is extended or adjusted under 35 U.S.C. 154(b) by 632 days.

(21) Appl. No.: 13/789,920

(22) Filed: Mar. 8, 2013

(65) Prior Publication Data

US 2013/0302195 A1 Nov. 14, 2013

Related U.S. Application Data

(60) Provisional application No. 61/644,727, filed on May 9, 2012.

(51) Int. Cl.
*A47K 5/12* (2006.01)
*F04B 7/00* (2006.01)
(Continued)

(52) U.S. Cl.
CPC ..... *F04B 7/00* (2013.01); *A47K 5/1207* (2013.01); *A47K 5/14* (2013.01); *B05B 7/0037* (2013.01);
(Continued)

(58) Field of Classification Search
CPC .. F04B 9/14; F04B 13/00; F04B 13/02; F04B 19/04; F04B 19/06; F04B 19/22;
(Continued)

(56) References Cited

U.S. PATENT DOCUMENTS 4,477,000 A 10/1984 Arabian
5,339,988 A 8/1994 Palmer et al.
(Continued)

FOREIGN PATENT DOCUMENTS

EP 011487 5/1980
WO 99/49769 10/1999

OTHER PUBLICATIONS

International Search Report and Written Opinion from International Application Serial No. US2013/040288, date of mailing Oct. 24, 2013.

*Primary Examiner* — William H Rodriguez
*Assistant Examiner* — Charles Nichols
(74) *Attorney, Agent, or Firm* — Calfee, Halter & Griswold LLP

(57) ABSTRACT

A foam pump including a housing and a piston that reciprocates within the housing is disclosed herein. The piston has a hollow portion and an orifice through the wall of the piston. A first seal located proximate the upper end of the piston provides a seal between the piston and the housing. A liquid inlet is located in the side wall of the housing at a point lower than the top of the piston. A one-way liquid inlet valve is located proximate the liquid inlet and a one-way liquid outlet valve is located prior to the liquid outlet. A charge chamber is defined at least in part by the liquid inlet valve, the liquid outlet valve, a wall of the piston and a wall of the housing.

23 Claims, 8 Drawing Sheets

(51) Int. Cl.
*B05B 7/00* (2006.01)
*B05B 11/00* (2006.01)
*A47K 5/14* (2006.01)

(52) U.S. Cl.
CPC ..... *B05B 11/0059* (2013.01); *B05B 11/3026* (2013.01); *B05B 11/3069* (2013.01); *B05B 11/0075* (2013.01); *B05B 11/3014* (2013.01)

(58) Field of Classification Search
CPC ..... F04B 23/02; F04B 23/021; F04B 23/023; F04B 23/04; F04B 23/08; F04B 23/10; F04B 23/106; F04B 37/18; F04B 37/20; F04B 53/12; F04B 53/125; F04B 53/126; F04B 41/02; F04B 41/06; A47K 5/1202; A47K 5/1204; A47K 5/1205; A47K 5/1207; B05B 7/0018; B05B 7/005; B05B 7/0031; B05B 7/0037; B05B 7/0043; B05B 7/0056
USPC ..... 222/181.3, 190, 325
See application file for complete search history.

(56) References Cited

U.S. PATENT DOCUMENTS 5,398,845 A 3/1995 Meyer
5,445,288 A 8/1995 Banks
5,544,788 A 8/1996 Meyer
5,779,104 A 7/1998 Reidel
5,862,954 A 1/1999 Ehrensperger et al.
6,082,586 A 7/2000 Banks
6,626,332 B2 9/2003 Ehrensperger et al.
6,644,516 B1 11/2003 Foster et al.
7,066,355 B2 6/2006 Lewis et al.
7,543,722 B2 6/2009 Yates et al.
7,611,033 B2 11/2009 Ganzeboom
7,735,692 B2 6/2010 Nelson
7,753,087 B2 7/2010 Rhodenbaugh et al.
2002/0153389 A1 10/2002 Creaghan
2005/0098580 A1 5/2005 Ciavarella
2009/0184134 A1 7/2009 Ciavarella et al.
2009/0184136 A1 7/2009 Ciavarella
2009/0184137 A1 7/2009 O'Brien
2009/0200337 A1 8/2009 Quinlan et al.
2009/0200338 A1 8/2009 Quinlan et al.
2009/0200339 A1 8/2009 Quinlan et al.
2009/0212073 A1 8/2009 Haworth
2009/0294477 A1 12/2009 Ciavarella et al.
2009/0294478 A1* 12/2009 Ciavarella et al. ..... 222/190
2009/0308894 A1* 12/2009 Ophardt ..... 222/190
2010/0102089 A1* 4/2010 Ophardt et al. ..... 222/137
2011/0079614 A1* 4/2011 Ganzeboom et al. ..... 222/181.3

* cited by examiner

LOW RESIDUAL INVERTED PUMPS, DISPENSERS AND REFILL UNITS

RELATED APPLICATIONS

This non-provisional utility patent application claims priority to and the benefits of U.S. Provisional Patent Application Ser. No. 61/644,727 filed on May 9, 2012, and entitled LOW RESIDUAL INVERTED LIQUID PUMP. This application is incorporated herein by reference in their entirety.

TECHNICAL FIELD

The present invention relates generally to pumps, refill units for dispensers and dispenser systems, and more particularly to inverted liquid and foam pumps having low residual fluid remaining in the container, as well as disposable refills/replacement units including such pumps.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. As a general matter, it is usually preferable to reduce the space taken up by the pumping and foaming apparatus within the overall dispenser system. This maximizes the available space for storing the liquid, and has other benefits.

SUMMARY

Simple and economical foam pumps, foam refill units and foam dispenser systems are provided. Embodiments of pumps that include a housing and a piston that reciprocates within the housing are disclosed herein. In one embodiment, the piston includes an outer wall. At least a portion of the center of the piston is hollow. The piston also includes an orifice in the piston wall that leads from the outside of the piston wall to the interior of the piston wall. A first seal is located proximate the upper end of the piston and provides a seal between the piston and the housing. The first seal is located above the orifice in the piston wall. The housing includes a liquid inlet therethrough that is located in the side wall of the housing at a point lower than the top of the piston. The pump also includes a one-way liquid inlet valve located proximate the inlet and a liquid outlet having a one-way liquid outlet valve. A charge chamber is defined at least in part by the one-way liquid inlet valve, the one-way liquid outlet valve, a wall of the housing and a wall of the piston. A mixing chamber is located downstream of the one-way liquid outlet valve. The mixing chamber has a liquid inlet and an air inlet. Embodiments of these pumps may be used in refill units and in foam dispensing systems.

In addition, embodiments of refill units and dispensers for refill units are also disclosed herein. In one embodiment, a refill unit for a dispenser includes: a container for holding a liquid, a neck formed in the container, a pump housing located at least partially within the neck and a piston having a sealing member that contacts a wall of the pump housing. The refill unit includes a fluid pathway between the neck of the container and the pump housing. A fluid inlet through the pump housing is located within the neck of the container to draw liquid from the fluid pathway. A one-way fluid inlet valve is located proximate the fluid inlet. A fluid outlet and associated one-way fluid outlet valve are also included. A charge chamber is defined at least in part by the one-way fluid inlet valve, the one-way fluid outlet valve; the pump housing and the piston. In addition, the refill unit includes an air inlet, a one-way air inlet valve and a mixing chamber. The mixing chamber is located downstream of the charge chamber and the one-way air inlet valve.

Another embodiment of a refill unit includes a container having a neck that has an inside diameter. The inside diameter of the neck has a smaller cross-sectional area than that of the cross-sectional area of the container. A pump housing is included that has an outside diameter that is smaller than the inside diameter of the neck to create a fluid flow path. A piston having a piston seal for engaging an inside wall of the pump housing is also included. The pump housing includes a fluid inlet to draw in fluid from the fluid flow path. A one-way fluid inlet valve and a one-way fluid outlet valve are also included. A charge chamber is defined at least in part by the fluid inlet valve, the fluid outlet valve, the pump housing and a wall of the piston. An opening in the wall of the piston allows fluid to flow from outside of the piston to the interior of the piston. Downstream of the opening is a mixing chamber that has a fluid inlet and an air inlet. Movement of the piston in an upward direction causes fluid to flow into the charge chamber and movement of the piston in the downward direction causes fluid to be expelled from the charge chamber into the mixing chamber. Pressurized air from the air inlet mixes with the fluid, and the mixture flows through a mix media and is dispensed as a foam.

BRIEF DESCRIPTION OF THE DRAWINGS

These and other features and advantages of the present invention will become better understood with regard to the following description and accompanying drawings in which.

DETAILED DESCRIPTION

Figure 1:
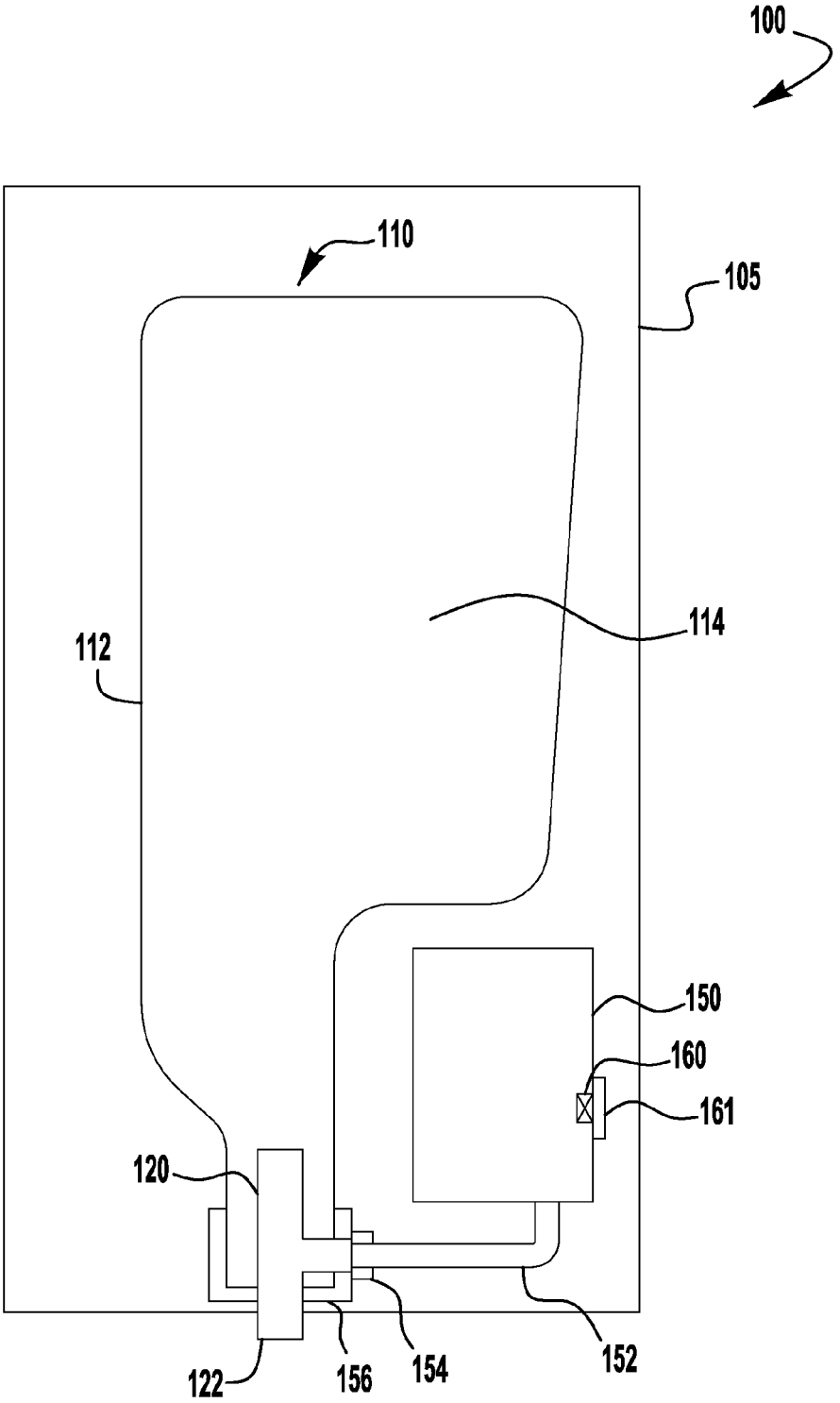
FIG. 1 illustrates a dispenser 100 having a air compressor attached thereto and a refill unit that includes a container, a liquid pump and an air inlet that is releasably connectable to the air compressor.

FIG. 1 illustrates an exemplary embodiment of a foam dispensing system 100. Foam dispensing system 100 includes a disposable refill unit 110 for use in a foam dispenser 105. The disposable refill unit 110 includes a container 112 connected to a pump 120. Pump 120 includes an air inlet 156. The disposable refill unit 110 may be placed within a housing of the dispenser 105 and releasably placed in fluid communication with air compressor 150. The foam dispenser system 100 may be a wall-mounted system, a counter-mounted system, an un-mounted portable system movable from place to place or any other kind of foam dispenser system. Foam dispenser 105 includes an air compressor 150 secured thereto. Air compressor 150 may be permanently mounted to foam dispenser 105. Air compressor 150 includes a conduit or air passage 152, with a connector 154 for releasably connecting to the air inlet 156 of pump 120. Optionally, connector 154 may be secured to pump 120. In one embodiment, connector 154 is a two-part connector, and one part is connected to pump 120 and the other to air passage 152. Accordingly, refill unit 110 and pump 120 may be removed from dispenser housing 105 and discarded without removal of the air compressor 150. Connector 154 may be a quick release connector, a releasable snap-fit connector, a releasable compression-fit connector or a sealing member such as, for example, a foam member that compresses to form a seal between tube 152 and pump 120.

The container 112 forms a liquid reservoir 114. The liquid reservoir 114 contains a supply of a foamable liquid within the disposable refill unit 110 and the dispensing system housing 105 which holds the refill unit 110. In various embodiments, the contained liquid could be for example a soap, a sanitizer, a cleanser, a disinfectant or some other foamable liquid. In the exemplary disposable refill unit 110, the liquid reservoir 114 is formed by a collapsible container 112, such as a flexible bag-like container, a thin molded plastic container or the like. In other embodiments, the liquid reservoir 114 may be formed by a rigid housing member, or have any other suitable configuration for containing the foamable liquid without leaking. The container 112 may advantageously be refillable, replaceable or both refillable and replaceable. In other embodiments, the container 112 may be neither refillable nor replaceable.

In the event the liquid stored in the reservoir 114 of the installed disposable refill unit 110 runs out, or the installed refill unit 110 otherwise has a failure, the installed refill unit 110 may be removed from the foam dispenser system 100. The empty or failed disposable refill unit 110 may then be replaced with a new disposable refill unit 110 including a liquid-filled reservoir 114. The air pump 150 remains located within the foam dispenser system 100 while the disposable refill unit 110 is replaced. In one embodiment, the air pump 150 is also removable from the housing of the dispenser system, separately from the disposable refill unit 110, so that the air pump 150 may be replaced without replacing the dispenser 105, or alternatively to facilitate removal and connection to the refill unit 110. Sanitary sealing isolates the air pump 150 from the portions of the foam pump 120 that contact liquid, so that the air pump mechanism does not contact liquid during operation of the foam pump 120. Sanitary sealing is described in more detail below.

The housing of the dispensing system 100 further contains one or more actuating members (not shown) to activate the foam pump 120. As will be appreciated by one of ordinary skill in the art, there are many different kinds of pump actuators which may be employed in the foam dispenser system 100. The pump actuator of the foam dispenser system may be any type of actuator, such as, for example, a manual lever, a manual pull bar, a manual push bar, a manual rotatable crank, an electrically activated actuator or other means for actuating the foam pump 120 within the foam dispenser system 100. Electronic pump actuators may additionally include a motion detector to provide for a hands-free dispenser system with touchless operation. Various intermediate linkages connect an external actuator member to the foam pump 120 within the system housing 100. The exemplary foam pump 120 is a "pull-activated" pump. That is, the pump 120 is actuated by pulling a valve stem downwardly. The external actuator may be operated in any manner, so long as the intermediate linkages transform that motion to a downward pulling force on the valve stem.

In one embodiment, air pump 150 includes an air inlet having a one-way air inlet valve 160 therethrough. One-way air inlet valve 160 allows air to enter air pump 150 to recharge the air pump 160. In one embodiment, the air inlet is located inside of housing 105 so that air from inside of the dispenser is used to feed the air pump 150. Using air from inside the housing 105 may help to prevent moisture from entering air pump 150 through air inlet and air inlet valve 160. In one embodiment, a barrier 161 is provided. In some embodiments barrier 161 is a vapor barrier that allows air to pass through and the air inlet and enter the air pump 150, but prevents moisture from entering air pump 150. A suitable vapor barrier is a woven one-way vapor barrier, such as, for example, Gortex®, that is arranged so that vapor does not enter air pump 150.

In some embodiments a filter, such as filter 980 (illustrated in FIG. 9) may be used to prevent bacteria or mold that may be in air pump 150 from passing through into the fluid being mixed with air to form a foam. Such filters are described in more detail with respect to FIG. 9, but may be used in any of the embodiments disclosed herein.

In one embodiment, air pump 150 includes an anti-microbial substance molded into the air pump housing. One suitable anti-microbial substance contains silver ions and or copper ions. A silver refractory, such as, for example, a glass, oxide, silver phosphate may be used. One suitable commercially available product is Ultra-Fresh, SA-18, available from Thomson Research Associates, Inc. The anti-microbial substance prevents mold or bacteria from growing inside of the air pump 150.

Figure 2:
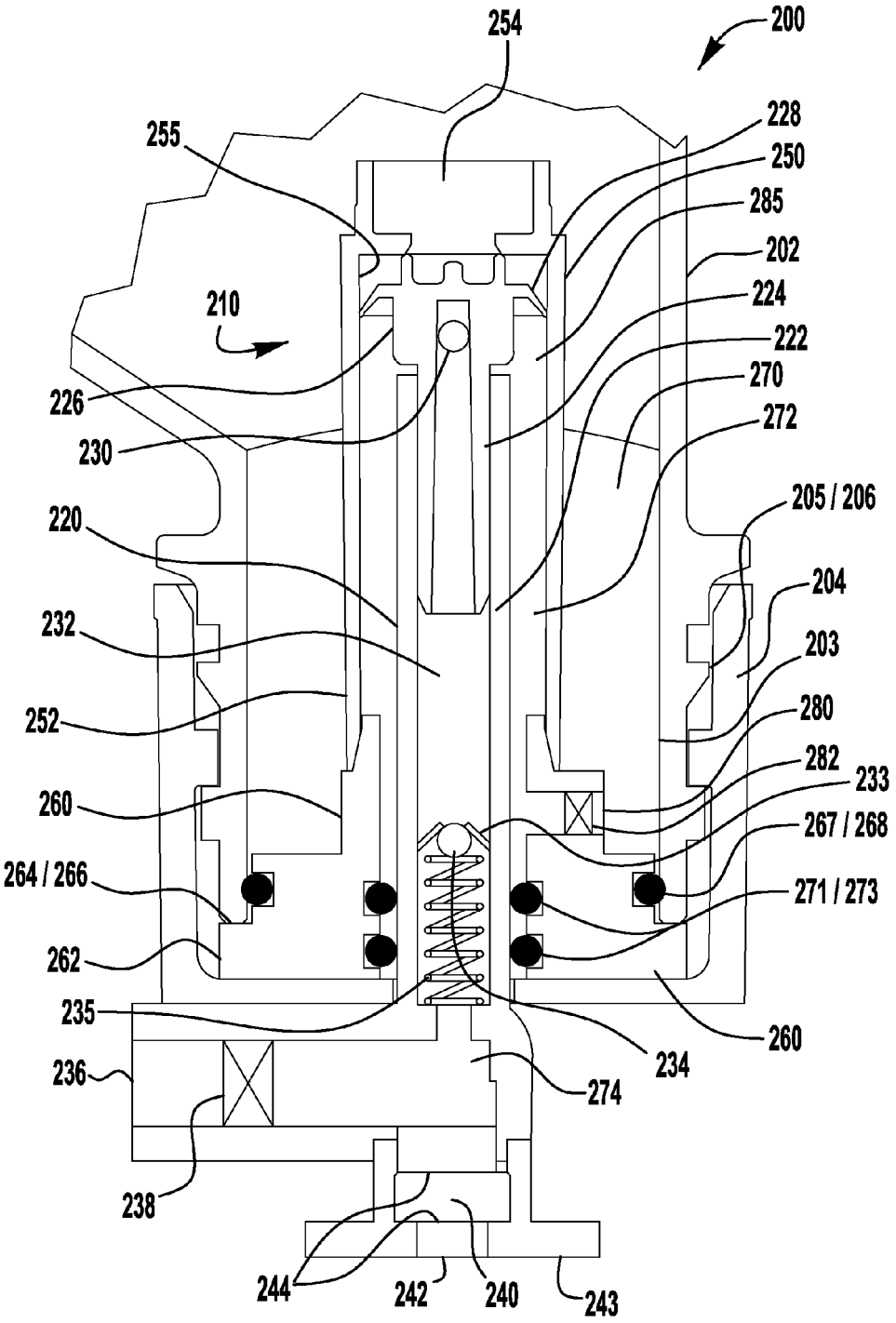
FIG. 2 illustrates a refill unit 200 showing a portion of a container 202 for holding a fluid and a pump 210 in a primed or priming position.
Figure 3:
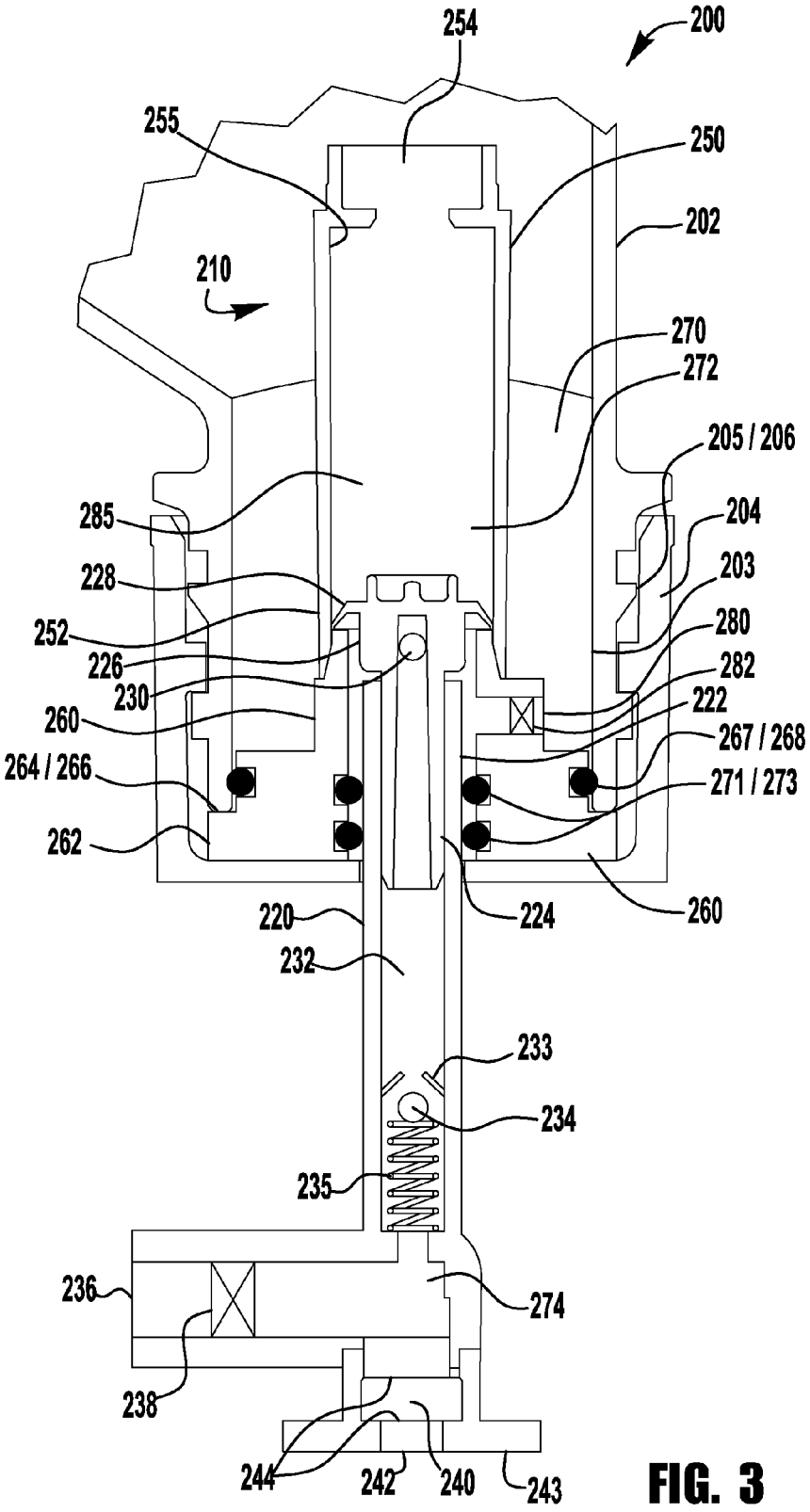
FIG. 3 illustrates refill unit 200 showing a portion of a container 202 for holding a fluid and a pump 210 in a dispensing or dispensed position.

FIGS. 2 and 3 illustrate an exemplary embodiment of a refill unit 200 that includes pump 210 and container 202. Container 202 includes a neck portion 203 that has male threads 205. Pump 210 is connected to container 202 by cap 204 which contains grooves 206 that mate with male threads 205. Optionally, cap 204 may connect to container 202 by other means, such as, for example, a compression fit, welding, adhesive, friction fit, etc. Pump 202 includes a piston 220. Piston 220 includes a first piston section 222 and a second piston section 224. Second piston section 224 connects to first piston section 222 by a snap-fit connection, pressure-fit connection, bonded connection, an adhesive connection or any other type of connection. Although piston 220 is described herein as having two piston sections, piston 220 may be comprised of a single section or multiple sections. A piston head 226 is located at the top of second piston section 224. Piston head 226 includes wiper seal 228.

Piston 220 fits within pump housing 250. Wiper seal 228 located on piston head 226 contacts the inside surface of pump housing 250. Pump housing 250 includes first pump housing section 252 and second pump housing section 260. Second pump housing section 260 connects to first pump housing section 252 by a snap-fit connection, pressure fit connection, bonded connection, an adhesive connection or any other type of connection. Although pump housing 250 is described as having two sections, embodiments having one or more sections are contemplated. Second pump housing section 260 includes an annular projection 262. Annular projection 262 is wider than the neck 203 of container 202. Annular projection 262 includes a surface 264 that mates with a corresponding surface 266 of the neck 203 of container 202. Second pump housing section 260 includes an annular groove 267 that holds a sealing member, such as o-ring 268, in place. O-ring 268 is compressed between the inside surface of the neck 203 and second pump housing section 260 to form a liquid tight seal between pump 210 and container 202.

Cap 204 includes an aperture therethrough which allows piston 220 to move up and down in pump housing 250. Second pump housing section 260 also includes a pair of annular grooves 271 located on the interior of its bore which hold o-rings 273. O-rings 273 form a seal between piston 220 and pump housing 250 to prevent liquid from escaping from between the piston 220 and pump housing 250. In one embodiment, o-rings 273 are replaced by a different type of sealing member, such as, for example, one or more wiper seals (not shown). In one embodiment, one or more wiper seals (not shown) are integrally formed with pump housing section 260.

Piston 220 has a hollow interior 232 and includes a one-way check valve, such as, for example, ball valve 234. One-way check valve, may be any type of check valve, such as, for example, a flapper valve, a conical valve, a plug valve, an umbrella valve, a duck-bill valve, a slit valve or a mushroom valve. Ball valve 234 seals against seat 233 to stop fluid from flowing from the mixing chamber 274 back into hollow interior. Piston 220 also includes an air inlet 236. Air inlet 236 may include a one-way check valve 238. One-way check valve 238 provides a sanitary seal that prevents liquid from flowing back through air inlet 236 and contaminating any portion of the air passageway (not shown) or air compressor (not shown) that remains with the dispenser (not shown) when refill unit 200 is removed. In one embodiment, a second one way check valve (not shown) is provide in line with one-way check valve 238 to provide redundancy for the sanitary seal. The second one-way check valve may be provided with the liquid pump or the air pump.

In addition, pump housing 260 includes one or more fluid inlets 280 therethrough. The one or more fluid inlets 280 include one or more one-way check valves 282. Check valves 282 may be any type of check valves, such as, for example, a flapper valve, a conical valve, a plug valve, an umbrella valve, a duck-bill valve, a slit valve, a mushroom valve, a spring and ball valve or any other one-way check valve. Preferably, fluid inlet(s) 280 and check valve(s) 282 are located near the bottom of the neck 203 of container 202. Such an arrangement allows for very little residual fluid to be left in container 202 when refill unit 200 is discarded.

In one embodiment, pump housing 250 includes an opening 254 located in the upper area of first pump housing section 252. Opening 254 prevents a vacuum from being created between piston head 226 and the first pump housing 252 as the piston 220 moves up and down within pump housing 250.

Preferably, the outside diameter of at least a portion of the pump housing 250 is less than the inside diameter of neck 203. Accordingly, a fluid passageway 270 is formed between pump housing 250 and neck 203. Fluid inlet 280 is located near the bottom of fluid passageway 270.

A fluid charge chamber 285 is formed in the area between the one-way fluid inlet valve 282 and the one-way fluid outlet valve 234. In one embodiment, the fluid charge chamber 285 includes a first fluid charge chamber portion 272 located on the outside of piston 220 between piston 220 and neck 203 and a second fluid charge chamber 232 located on the interior of piston 220. First and second fluid charge chambers 272, 232 are connected by aperture 230 that extends through piston 220.

Piston 220 includes a mixing chamber 274 where fluid flowing from the fluid charge chamber 285 and air flowing through the air conduit 236 meet and mix together to form a mixture. Downstream of the mixing chamber 274 is one or more mix media 244. Mix media 244 may be, for example, one or more screen(s), mesh(es), sponge(s), a foaming cartridge or combinations thereof. Downstream of mix media 244 is an outlet 242. Secured to piston 220 is an annular flange 243. Annular flange 243 may be used to transfer force created by the dispenser (not shown) to move piston 220 up and down. Alternatively, piston 220 may be engaged by the dispenser by other means, such as, for example, a releasable clamp (not shown) that grips piston 220, at for example, the tube surrounding inlet 236.

As can be seen from the figures, pump 210 is compact, and in one embodiment, substantially all of the liquid pump portion is located within the neck of container 202. The only portions of pump 210 that are located outside of the neck of container 202 is the air inlet 236, outlet nozzle 240 and annular flange 243 that connects to a dispenser. This compact profile reduces shipping costs. Further, the ability to reuse the air compressor (not shown) provides sustainability and is "green" in that it reduces the amount of plastic that ends up in landfills.

FIG. 2 illustrates pump 210 with the piston 220 in an upper position, which is the charged or primed position. FIG. 3 illustrates pump 210 with piston 220 in a lower position, which is the dispensed or dispensing position. As piston 220 moves from the dispensed position of FIG. 3 to the primed position of FIG. 2, the volume of charging chamber 285 is increased. The wiper seal 228 is in contact with the inside of pump housing 250 forming a seal. Outlet valve 234 moves to its closed position. Seal 228 is stiff enough so that as it moves up in pump housing 250, fluid from above the top of piston head 226 is urged out of the top of pump housing 250 through opening 254. Thus, fluid above the top of piston head 226 does not enter charge chamber 285. Rather, fluid from container 202 is drawn by the vacuum created by the expansion of charge chamber 285 through fluid passageway 270 into fluid inlet 280 past one-way check valve 282 and into charge chamber 285 until piston 220 moves to its upper position illustrated in FIG. 2.

As piston 220 moves from the charged or primed position towards the lower position shown in FIG. 3, the volume of charge chamber 272 is reduced. Seal 228 rides against pump housing 250 and prevents liquid from flowing past piston head 226 into the upper section of pump housing 250. One-way inlet valve 282 closes and fluid flows from outside of piston 220 through orifice 230, through the center of piston 220 and past outlet valve 234 into mixing chamber 274.

Pressurized air from an air compressor (not shown) flows through air inlet 236, past one-way valve 238 and into mixing chamber 274 where the air and fluid mix together forming a course foam mixture. The mixture is forced through mix media 244 and is dispensed out of nozzle 242. The pressurized air may be introduced to the mixing chamber simultaneously with the liquid, it may be introduced to the mixing chamber prior to the fluid entering the mixing chamber, it may continue to be introduced to the mixing chamber after the fluid stops flowing into the mixing chamber, or combinations thereof.

The air compressor may be any type of air compressor such as, for example, a bellows, a rotary air pump, a piston air pump, a fan, a compressor, etc.

Although the embodiments illustrated in the figures have the air compressor portion secured to the dispenser, in some embodiments the air compressor is secured to the pump and/or container. In such embodiments, the air compressor may be disposable with the refill units.

Figure 4:
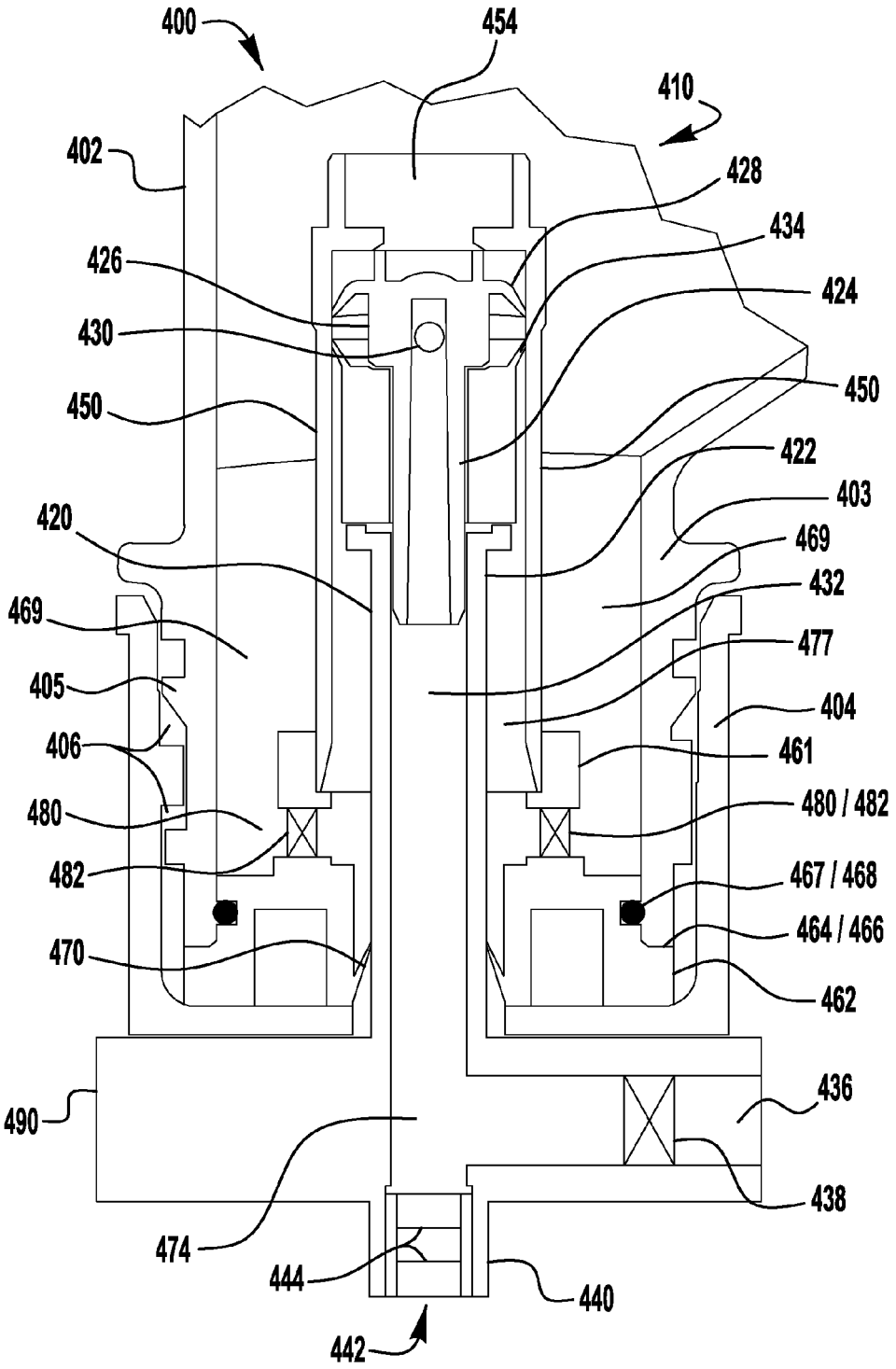
FIG. 4 illustrates a refill unit 400 showing a portion of a container 402 for holding a fluid and a pump 410 in a prime or priming position.
Figure 5:
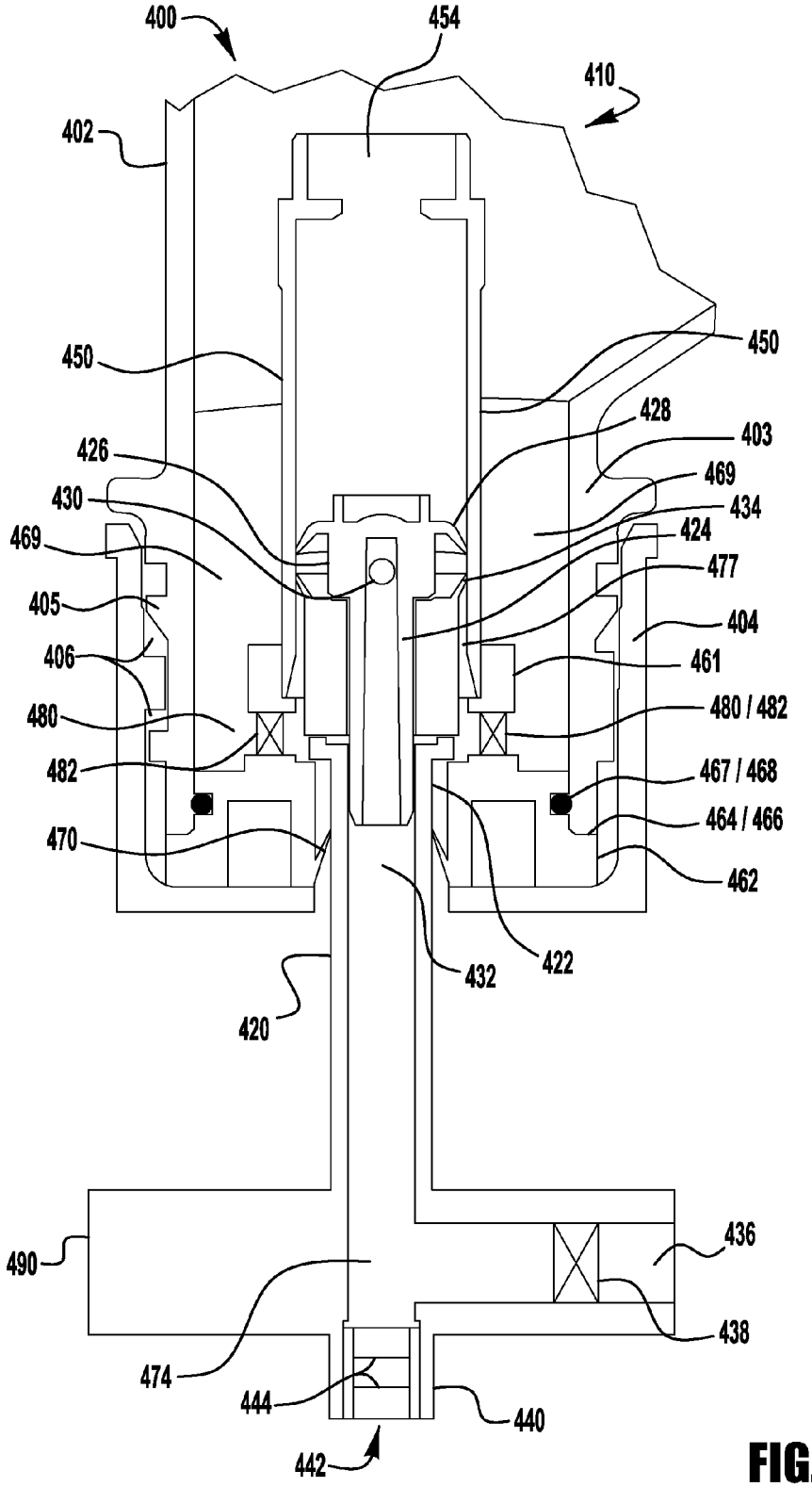
FIG. 5 illustrates refill unit 400 showing a portion of a container 402 for holding a fluid and a pump 410 in a dispensing or dispensed position.

FIGS. 4 and 5 illustrate an embodiment of a refill unit 400 that includes pump 410 and container 402. Container 402 includes a neck portion 403 that has male threads 405. Pump 410 is connected to container 402 by a cap 404 which contains grooves 406 that mate with male threads 405. Optionally, cap 404 may connect to container 402 by other means, such as, for example, a compression fit, welding, adhesive, friction fit, etc. Pump 410 includes a piston 420. Piston 420 includes a first piston section 422 and a second piston section 424. Second piston section 424 connects to first piston section 422 by a snap-fit connection, pressure fit connection, bonded connection, an adhesive connection or any other type of connection. Although piston 420 is described herein as having two piston sections, piston 420 may be comprised of a single section or multiple sections. A piston head 426 is located on the top of second piston section 424. Piston head 426 includes wiper seal 428. In addition, piston 420 includes a second wiper seal 434. Second wiper seal 434 may be formed integrally with one of piston sections 422, 424 or may be a separate molded piece that connects to one of the other piston sections 422, 424. In one embodiment, second wiper seal 434 includes a body 425 that has a bore therethrough. Second piston section 424 fits through the bore and secures body 425 to piston 420. As discussed in more detail below, second wiper seal 434 forms an outlet valve to charging chamber 477.

Piston 420 fits within pump housing 450. Pump housing 450 includes first pump housing section 452 and second pump housing section 461. Second pump housing section 461 connects to first pump housing section 452 by a snap-fit connection, pressure fit connection, bonded connection, an adhesive connection or any other type of connection. Second pump housing section 461 includes an annular projection 462. Annular projection 462 is wider than the neck 403 of container 402. Annular projection 462 includes a surface 464 that mates with a corresponding surface 466 of the neck 403 of container 402. Second pump housing section 461 includes an annular groove 467 that holds a sealing member, such as o-ring 468, in place. O-ring 468 is compressed between the inside surface of the neck 403 and second pump housing section 461 to form a liquid tight seal between pump 410 and container 402. Cap 404 includes an aperture therethrough which allows piston 420 to move up and down in pump housing 450. Second pump housing section 461 includes a sealing member 470 located on the interior of its bore. Sealing member 470 is a wiper seal. Sealing member 470 forms a seal between piston 420 and pump housing 450 to prevent fluid from escaping from between the piston 420 and pump housing 450. In one embodiment, sealing member 470 is replaced by a different type of sealing member, such as, for example, one or more o-rings (not shown). In one embodiment, sealing member 470 is integrally formed with pump housing section 461.

Piston 420 has a hollow interior 432. Piston 420 also includes an air inlet 436. Air inlet 436 may include a one-way check valve 438. One-way check valve 438 provides a sanitary seal that prevents liquid from flowing through air inlet 436 and contaminating any portion of the air passageway (not shown) or air compressor (not shown) that remains with the dispenser when refill unit 400 is removed. In one embodiment, a second one way check valve (not shown) is provide in line with one-way check valve 438 to provide redundancy for the sanitary seal. The second one-way check valve may be provided with the liquid pump or the air pump.

In addition, pump housing 450 includes one or more fluid inlets 480 therethrough. The one or more fluid inlets 480 include one or more one-way check valves 482. Check valves 482 may be any type of check valves, such as, for example, a flapper valve, a conical valve, a plug valve, an umbrella valve, a duck-bill valve, a slit valve, a mushroom valve, a spring and ball valve or any other one-way check valve. Preferably, fluid inlets 480 and check valves 482 are located near the bottom of the neck 403 of container 402. Such an arrangement allows for very little residual fluid to be left in container 402 when refill unit 400 is discarded. In one embodiment, pump housing 450 includes an opening 454 located in the upper area of first pump housing 452. Opening 454 prevents a vacuum from being created between piston head 426 and the first pump housing 452 as the piston 420 moves up and down within pump housing 450.

In one embodiment, the outside diameter of the pump housing 450 is less than the inside diameter of neck 403. Accordingly, a fluid passageway 469 is formed between pump housing 450 and neck 403. Fluid inlet(s) 480 is located near the bottom of fluid passageway 469. In one embodiment, a fluid charge chamber 477 that consists of an area between the one-way fluid inlet valve 482 and the one way fluid outlet valve 434. The fluid charge chamber 477 is located on the outside of piston 420 between piston 420 and the pump housing 450.

Piston 420 includes a mixing chamber 474 where fluid flowing from the fluid charge chamber 477 through aperture 430 and fluid passage 432 meets air flowing through air conduit 436. In the mixing chamber 474, the air and fluid mix together to form a mixture. Downstream of the mixing chamber 474 is one or more mix media 444. Mix media 444 may be, for example, one or more screen(s), mesh(es), sponge(s), foaming cartridge(s) or combinations thereof. Downstream of mix media 444 is an outlet nozzle 442. In addition, secured to piston 420 is an engagement mechanism 490. Engagement mechanism 490 may be used to transfer force created by the dispenser (not shown) to move piston 420 up and down.

As can be seen from the figures, pump 410 is compact, and in one embodiment, substantially all of the liquid pump portion is located within the neck of container 402. The only portions of pump 410 that are located outside of the neck of container 402 are the air inlet 436, outlet nozzle 442 and engagement mechanism 490 which connect to a dispenser. This compact profile reduces shipping costs. In addition, reusing the air compressor portion and not disposing of the air compressor portion each time a refill unit is replaced reduces waste and the amount of plastic ending up in landfills.

FIG. 4 illustrates pump 410 with the piston 420 in an upper position, which is the charged or primed position. FIG. 5 illustrates pump 410 with piston 420 in a lower position, which is the dispensed or dispensing position. As piston 420 moves from the dispensing position of FIG. 5 to the primed position of FIG. 4, the volume of charge chamber 477 is increased. The wiper seal 428 is in contact with the inside of pump housing 250 creating a vacuum in the charge chamber 477. Outlet valve or wiper seal 434 moves to its closed position. Seal 428 is stiff enough so that as it moves up in pump housing 450, fluid from above the top of piston head 426 is urged out of the top of pump housing 450 through opening 454. Thus, fluid above the top of piston head 426 does not enter charge chamber 477. Rather, fluid from container 402 is drawn by the vacuum created by the expansion of charge chamber 477 from fluid passageway 469 into fluid inlet 480 past one-way check valve 482 and into charge chamber 477 until piston 420 moves to its upper position illustrated in FIG. 4.

As piston 420 moves from the charged or primed position towards the lower position shown in FIG. 5, the volume of charge chamber 477 is reduced. Seal 428 rides against pump housing 450 and prevents liquid from flowing past piston head 426 into the upper section of pump housing 250. Fluid flows from outside of piston 420 past wiper seal 434, which acts as an outlet valve for the charging chamber 477, through orifice 430, through the center of piston 420 and into mixing chamber 474. Pressurized air from an air compressor (not shown) flows through air inlet 436 past one-way valve 438 and into mixing chamber 474 where the air and fluid mix together forming a course foam mixture. The mixture is forced through mix media 444 and is dispensed out of nozzle 442. The pressurized air may be introduced to the mixing chamber simultaneously with the liquid, it may be introduced to the mixing chamber prior to the fluid entering the mixing chamber, it may continue to be introduced to the mixing chamber after the fluid stops flowing into the mixing chamber, or combinations thereof.

Figure 6:
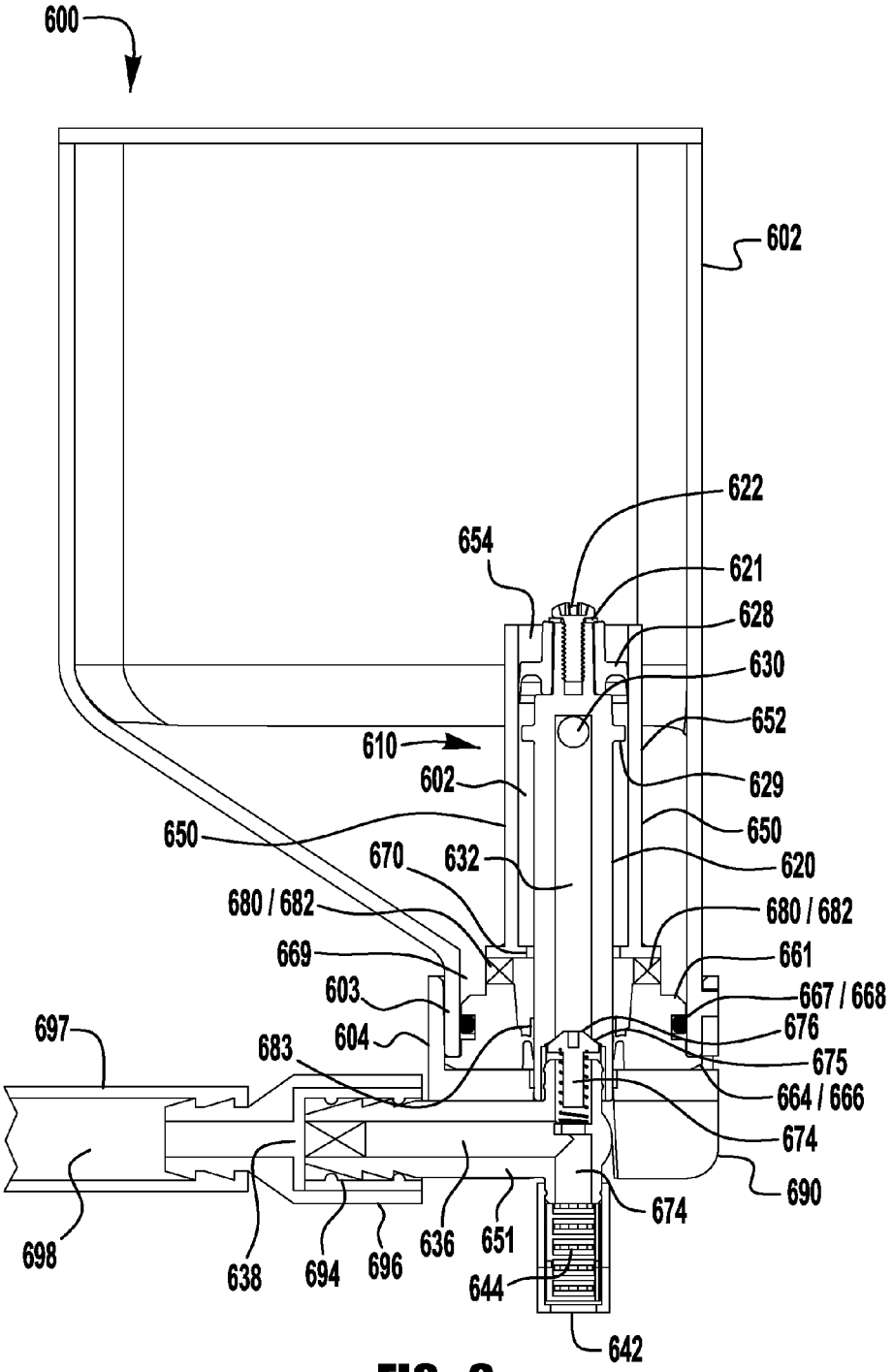
FIG. 6 illustrates a refill unit 600 showing a container 602 for holding a fluid and a pump 610 in a prime or priming position.
Figure 7:
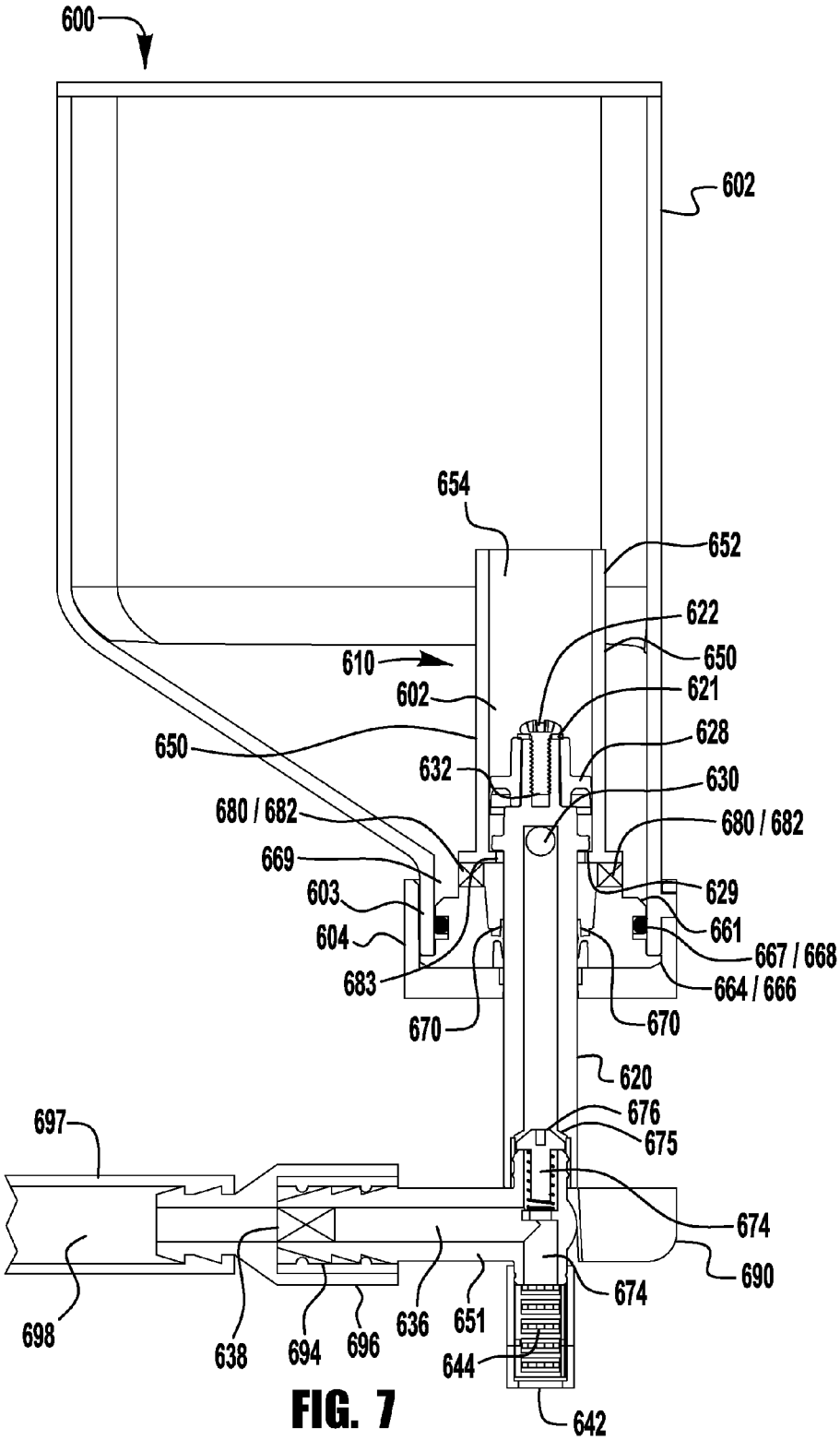
FIG. 7 illustrates refill unit 600 showing a portion of a container 602 for holding a fluid and a pump 610 in a dispensing or dispensed position.

FIGS. 6 and 7 illustrate an embodiment of a refill unit 600 that includes pump 610 and container 602. Container 602 includes a neck portion 603. Pump 610 is connected to container 602 by a cap 604 in a liquid tight manner by, for example, an adhesive, threads, a compression fit, welding, friction fit, etc. Pump 610 includes a piston 620. One end of piston 620 includes a projection member 621. A wiper seal 628 is secured to piston 620. Wiper seal 628 is secured to piston 620 with a screw 622; however, wiper seal 628 may be secured to piston 620 by any means, such as, for example, by adhesive. Optionally, wiper seal 628 may be integrally formed with piston 620.

In addition, piston 620 includes one or more second projecting member(s) 629. Projecting members 629 do not form a seal against housing 650 and allow liquid to freely flow past. In one embodiment, projecting members 629 steady piston 620 and prevent back and forth wobbling as the piston 620 moves.

Piston 620 is connected to lower section 651 by a snap fit connection. However, piston 620 may be connected to lower section 651 by other means, such as, for example, adhesive, threads, friction fit, etc. In one embodiment, lower section 651 is formed as an integral part of piston 620. In one embodiment, piston 620 includes a valve seat 675 that meets with a surface 676 of one-way outlet valve 674. One-way outlet valve 674 may be any type of one-way check valve, such as, for example, a slit valve, a poppet valve, an umbrella valve, a check valve, etc. Piston 620 has a hollow interior which forms a portion of a fluid charging chamber 632. The fluid charging chamber 632 is also formed by chamber 602 which surrounds piston 620 and is at least partially enclosed by pump housing 650.

Lower section 651 has a hollow interior that includes an air inlet 636. Air inlet 636 may include a one-way check valve 638. One-way check valve 638 provides a sanitary seal that prevents liquid from flowing through air inlet 636 and contaminating any portion of the air passageway 698 or air compressor (not shown) that remains with the dispenser when refill unit 600 is removed. Lower section 651 includes a mixing chamber 674. Mixing chamber 674 is located at a point where liquid flowing from the fluid charge chamber 632 mixes with air flowing through the air inlet 636 to form a mixture. In one embodiment, a second one way check valve (not shown) is provide in line with one-way check valve 638 to provide redundancy for the sanitary seal. The one-way check valve may be provided with the liquid pump or the air pump.

Downstream of the mixing chamber 674 is one or more mix media 644. Mix media 644, may be, for example, one or more screen(s), mesh(es), sponge(s), foaming cartridge(s), a series of baffles, or combinations thereof. Downstream of mix media 644 is an outlet nozzle 642. In addition, secured to piston 620 is an engagement mechanism 690. Engagement mechanism 690 may be used to transfer force created by the dispenser (not shown) to move piston 620 (including lower section 651) up and down.

In one embodiment, lower section 651 includes a barbed end 694. Barbed end 694 is used to releasably connect refill unit 600 to an air compressor (not shown). Barbed end 694 fits into connector 696. Connector 696 is secured to the dispenser (not shown). In one embodiment connector 696 also includes a barbed section that connects to an air conduit 697. Other types of releasable connectors may be used such as, for example, a compression fit, a snap fit, etc.

Piston 620 fits within pump housing 650. Pump housing 650 includes first pump housing section 652 and second pump housing section 651. Second pump housing section 661 connects to first pump housing section 652 by a snap-fit connection, pressure fit connection, bonded connection, an adhesive connection or any other type of connection. Although pump housing 650 is described as being made of two sections, pump housing 650 may be made up of one section or more than two sections.

Second pump housing section 661 includes an annular projection 662. Annular projection 662 is wider than the neck 603 of container 602. Annular projection 662 includes a surface 664 that mates with a corresponding surface 666 of the neck 603 of container 602. Second pump housing section 661 includes an annular groove 667 that holds a sealing member, such as, for example, an o-ring 668, in place. O-ring 668 is compressed between the inside surface of the neck 603 and second pump housing section 661 to form a liquid tight seal between pump 610 and container 602. Cap 604 includes an aperture therethrough which allows piston 620 to move up and down in pump housing 650. Second pump housing section 651 includes a sealing member 683 located on the interior of its bore. Sealing member 683 is wiper seal. Sealing member 683 forms a seal between piston 620 and pump housing 650 to prevent fluid from escaping from between the piston 620 and pump housing 650. In one embodiment, wiper seal 683 is replaced by a different type of sealing member, such as, for example, one or more o-rings (not shown). In one embodiment, sealing member 683 is integrally formed with pump housing section 661.

In addition, pump housing 650 includes one or more fluid inlets 680 therethrough. The one or more fluid inlets 680 include one or more one-way check valves 682. Check valves 682 may be any type of check valves, such as, for example, a flapper valve, a conical valve, a plug valve, an umbrella valve, a duck-bill valve, a slit valve, a mushroom valve, a spring and ball valve or any other one-way check valve. Preferably, fluid inlets 680 and check valves 682 are located near the bottom of the neck 603 of container 602. Such an arrangement allows for very little residual fluid to be left in container 602 when refill unit 600 is discarded. In one embodiment, pump housing 650 includes an opening 654 located in the upper area of first pump housing 652.

Opening 654 prevents a vacuum from being created between piston head 626 and the first pump housing 652 as the piston 620 moves up and down within pump housing 650.

In one embodiment, the outside diameter of the pump housing 650 is less than the inside diameter of neck 603. Accordingly, a fluid passageway 669 is formed between pump housing 650 and neck 603. Fluid inlet(s) 680 is located near the bottom of fluid passageway 669. Fluid charge chamber 632 consists of an area between the one-way fluid inlet valve 682 and the one way fluid outlet valve 674.

As can be seen from the figures, pump 610 is compact. The only portions of pump 610 that are located outside of the neck of container 602 the air inlet 636, outlet nozzle 642 and engagement mechanism 690, which connect to a dispenser. This compact profile reduces shipping costs. In addition, re-using the air compressor portion and not disposing of the air compressor portion each time a refill unit is replaced reduces waste and the amount of plastic ending up in landfills.

FIG. 6 illustrates pump 610 with the piston 620 in an upper position, which is the charged or primed position. FIG. 7 illustrates pump 610 with piston 620 in a lower position, which is the dispensed, or dispensing position. As piston 620 moves from the dispensing position of FIG. 7 to the primed position of FIG. 6, the volume of charge chamber 632 is increased. The wiper seal 628 is in contact with the inside of pump housing 650 creating a vacuum in the charge chamber 632. Outlet valve or wiper seal 634 moves to its closed position. Seal 628 is stiff enough so that as it moves up in pump housing 650, fluid from above the top of piston head 626 is urged out of the top of pump housing 650 through opening 654. Thus, fluid above the top of piston head 626 does not enter charge chamber 632. Rather, fluid from container 602 is drawn by the vacuum created by the expansion of charge chamber 632 from fluid passageway 669 into fluid inlet 680 past one-way check valve 682 and into charge chamber 632 until piston 620 moves to its upper position illustrated in FIG. 6.

As piston 620 moves from the charged or primed position towards the lower position shown in FIG. 7, the volume of charge chamber 632 is reduced. Seal 628 rides against pump housing 650 and prevents liquid from flowing past piston head 626 into the upper section of pump housing 650. Fluid flows from outside of piston 620 past wiper seal 634, which acts as an outlet valve for the charging chamber 632, through orifice 630, through the center of piston 620 and into mixing chamber 674. Pressurized air from an air compressor (not shown) flows through air inlet 636 past one-way valve 638 and into mixing chamber 674 where the air and fluid mix together forming a course foam mixture. The mixture is forced through mix media 644 and is dispensed out of nozzle 642. The pressurized air may be introduced to the mixing chamber 674 simultaneously with the liquid, it may be introduced to the mixing chamber 674 prior to the fluid entering the mixing chamber 674, it may continue to be introduced to the mixing chamber 674 after the fluid stops flowing into the mixing chamber 674, or combinations thereof.

Figure 8:
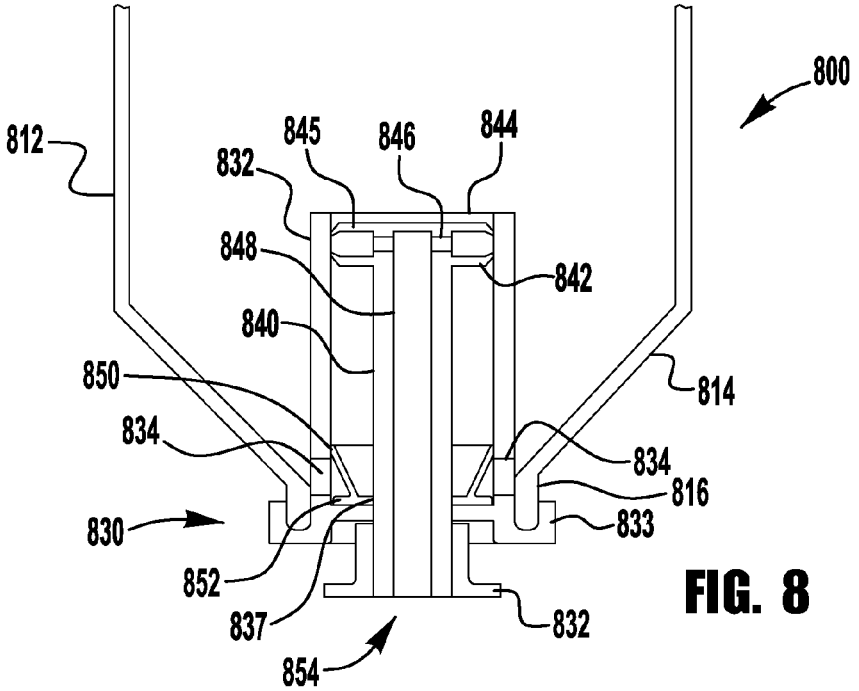
FIG. 8 illustrates a refill unit 800 showing a portion of a container 812 for holding a fluid and a liquid pump 830.

FIG. 8 illustrates an exemplary cross-section of a refill unit 800 having a liquid pull pump 830 secured to a container 812. In some embodiments, container 812 includes tapered walls 814 and neck 816. The tapered walls 814 may be considered to be part of the neck 816. Pump 830 includes a cap 833. Cap 833 is secured to the neck 816 of container 812 by a snap-fit connection. Optionally, the connection may be made by an adhesive connection, a friction fit-connection, a threaded connection or the like. In some embodiments the container neck 816 and cap 833 are longer to provide a connection with more overlap. Pump housing 832 is cylindrical and includes an open end 844. Located near the base of housing 832 is one or more liquid inlet apertures 834. Cap 833 and housing 832 are a single molded piece, however, they may be multiple pieces and/or made of different materials. Housing 832 also includes an aperture 837 in cap 833 that allows piston 840 to move up and down in a reciprocating motion. Piston 840 has a hollow interior 848. Located at the upper end of piston 840 is a first wiper seal 842 and a second wiper seal 845. Located between first wiper seal 842 and second wiper seal 845 are one or more apertures 846 that lead to the hollow interior 848.

A connector 852 is secured to a second end of piston 840. The connector 842 provides a means for an actuator (not shown) of a dispenser (not shown) to mate with piston 840 to move piston 840 up and down in a reciprocating fashion.

A sealing member 852 is seals against piston 840 to prevent fluid from leaking out of charge chamber 847 around piston 840. In addition, sealing member 852 includes a wiper seal 850 that seals against the sides of housing 832. Sealing member 852 is stationary and does not move up and down with piston 840. Wipe seal 850 acts as a liquid inlet valve to charge chamber 847.

During operation, when the pump 830 is in the position illustrated in FIG. 8, charge chamber 847 is primed or filled with liquid. As piston 840 is moved downward, the volume of charge chamber 847 is reduced. Fluid is prevented from exiting charge chamber 847 through liquid inlet apertures 834 by wiper seal 850. Accordingly, fluid is forced past wiper seal 842 into the area between wiper seal 842 and wiper seal 845. Wiper seal 845 prevents fluid from flowing past wiper seal 845 into container 812. Accordingly, the fluid flows through aperture(s) 846 into the hollow interior 848 of piston 840 and down through the outlet 854.

Once piston 840 travels to its end of stroke, the piston is moved back up toward the position illustrated in FIG. 8. The end of stroke may be a complete stroke for a full dose, or a partial stroke for a smaller dose. Accordingly, pump 830 is a variable volume pump. As the piston 840 is moved upward, wiper seal 842 seals against the wall of housing 832 and creates a vacuum pressure in charge chamber 847. The vacuum pressure causes fluid to flow from container 812 through liquid inlet apertures 834, past wiper seal 850 and into charge chamber 847. Accordingly, the charge chamber 847 is filled with fluid, or primed, and the pump 830 is ready for the next dispense cycle.

Figure 9:
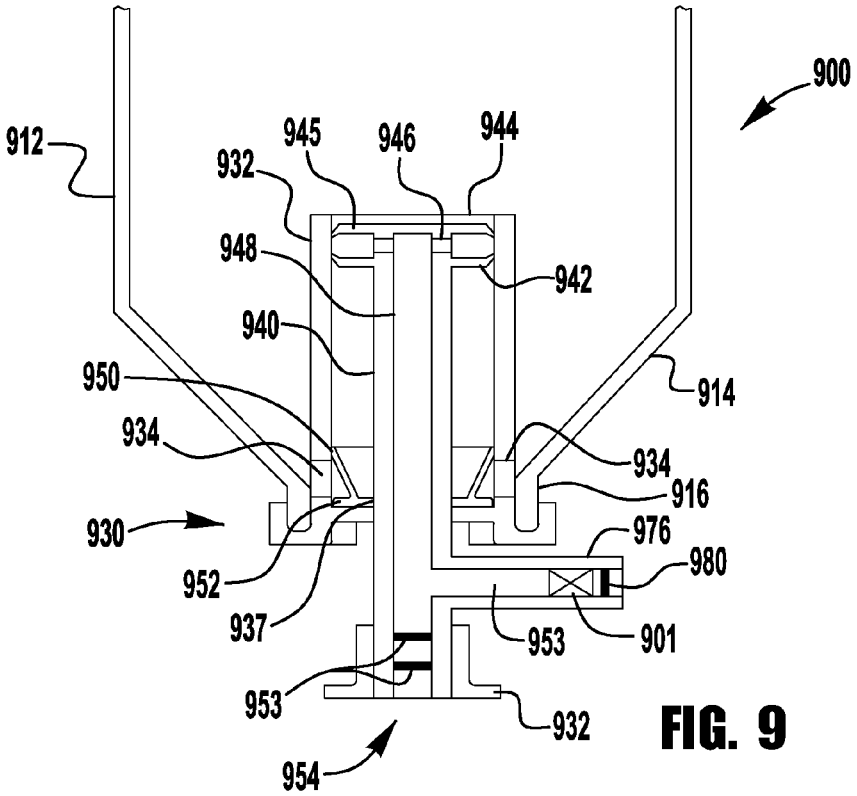
FIG. 9 illustrates a refill unit 900 showing a portion of a container 912 for holding a fluid and a foam pump 930.

FIG. 9 illustrates an exemplary cross-section of a refill unit 900 having a foam pull pump 930 secured to a container 912. In some embodiments, container 912 includes tapered walls 914 and neck 916. Pump 930 includes a cap 933. Cap 933 is secured to the neck 916 of container 912 by a snap-fit connection. Optionally, the connection may be made by an adhesive connection, a friction fit-connection, a threaded connection or the like.

In some embodiments the container neck 916 and cap 933 are longer to provide a connection with more overlap. Pump housing 932 is cylindrical and includes an open end 944. Located near the base of housing 932 are one or more liquid inlet apertures 934. Cap 933 and housing 932 are a single molded piece; however, they may be multiple pieces and/or made of different materials. Housing 932 also includes an aperture 937 in cap 933 that allows piston 940 to move up and down in a reciprocating motion. Piston 940 has a hollow interior 948. Located at the upper end of piston 940 are a first wiper seal 942 and a second wiper seal 945. Located between first wiper seal 942 and second wiper seal 945 are one or more apertures 946 that lead to the hollow interior 948.

Piston 940 includes a cylindrical projection 976 extending outward. Cylindrical projection 876 is an air inlet. Cylindrical projection 976 connects to an air source (not shown) in any manner, such as, for example, those described above. The air source may be part of the refill unit 900 or part of a dispenser (not shown) and be connectable to projection 876 to provide air to mix with fluid flowing through the liquid pump portion.

A connector 952 is secured to a second end of piston 940. The connector 942 provides a means for an actuator (not shown) of a dispenser (not shown) to mate with piston 940 to move piston 940 up and down in a reciprocating fashion.

In embodiments where the air source (not shown) remains with the dispenser (not shown) pump 930 may include a one-way air inlet valve 901. One-way air inlet valve 901 is a sanitary valve in that it prevents liquid from contaminating the air source (not shown) with liquid which might cause mold in the permanent air source.

Pump 930 also includes a foaming cartridge 953 to aid in mixing liquid and air to form foam. Foaming cartridge 953 may be one or more screens, baffles, a sponge, a porous member or the like.

A sealing member 952 is seals against piston 940 to prevent fluid from leaking out of charge chamber 947 around piston 940. In addition, sealing member 952 includes a wiper seal 950 that seals against the sides of housing 932. Sealing member 952 is stationary and does not move up and down with piston 940. Wipe seal 950 acts as a liquid inlet valve to charge chamber 847.

During operation, when the pump 930 is in the position illustrated in FIG. 9, charge chamber 947 is primed or filled with liquid. As piston 940 is moved downward, the volume of charge chamber 947 is reduced. Fluid is prevented from exiting charge chamber 947 through liquid inlet apertures 934 by wiper seal 950 and therefore is forced past wiper seal 942 into the area between wiper seal 942 and wiper seal 945. Wiper seal 945 prevents fluid from flowing past wiper seal 945 into container 912. Accordingly, the fluid flows through aperture(s) 946 into the hollow interior 948 of piston 940.

Simultaneously, air is forced through the air inlet 902 where it mixes with the liquid flowing through hollow interior 948. The liquid/air mixture is forced through foaming cartridge 953 where it forms into a rich foam. The foam is dispensed out of outlet 954.

Once piston 940 travels to its end of stroke, the piston is moved back up toward the position illustrated in FIG. 9. The end of stroke may be a complete stroke for a full dose, or a partial stroke for a smaller dose. Accordingly, pump 930 is a variable volume pump. As the piston 940 is moved upward, wiper seal 942 seals against the wall of housing 932 and creates a vacuum pressure in charge chamber 947. The vacuum pressure causes fluid to flow from container 912 through liquid inlet apertures 934, past wiper seal 950 and into charge chamber 947. Accordingly, the charge chamber 947 is filled with fluid, or primed, and the pump 930 is ready for the next dispense cycle. Similarly, the air source (not shown) recharges with air.

In addition, a filter 980 is located in the air inlet passage 953. The filter 980 may selected and sized to prevent mold and/or bacteria from passing from an air source (not shown) that is permanently mounted to a dispenser (not shown). In some embodiments, filter 980 has a pore size is about 0.2 um. Such a pore size would provide an air input that is sterile and free of most viruses. In some embodiments the pore sized is about 0.45 um, which would provide an air input that is free of most bacteria. In some embodiments, the filet may be selected to filter out visible particles or particles in the mm size range.

In addition, in some embodiments, a filter having a MERV 5 or less range may be used. In some embodiments, a filter having a rating of between about MERV 5 to about a MERV 8 may be used. In some embodiments a filter having a rating of MERV 5 or higher may be used. Still yet, in some embodiments a filter having a rating of between about a MERV 9 to about a MERV 12 may be used. In some embodiments a rating of about MERV 13 or higher may used.

In some embodiments, filter 980 is chosen to filter air, but is also chosen from a material that may get wet and still work ok. Such a filter is preferable in locations where a dispenser may be splashed with water, where the dispenser is located in a shower or where the dispenser is located in an area of high humidity.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A pull pump comprising:
- a housing;
- a piston that reciprocates within the housing;
- the piston having an outer wall and at least a portion of the center of the piston is hollow;
- the piston includes an orifice form the outer wall to the center of the piston;
- a first seal is located proximate the upper end of the piston to provide a seal between the piston and the housing;
- the first seal is located above the orifice in the piston wall;
- a liquid inlet in the side wall of the housing at a point lower than the top of the piston;
- a one-way liquid inlet valve;
- a liquid outlet having a one-way liquid outlet valve;
- a charge chamber defined at least in part by the one-way liquid inlet valve, the one-way liquid outlet valve, a wall of the housing and a wall of the piston; and
- a mixing chamber located downstream of the one-way liquid outlet valve;
- wherein the charge chamber is dispensed by pulling the piston downward and recharged by moving the piston upward.

2. The pull pump of claim 1 further comprising an air inlet in fluid communication with the liquid outlet and a foaming element located downstream of the air inlet and the liquid outlet.

3. The pull pump of claim 1 wherein the liquid inlet valve is lower than the liquid outlet valve.

4. The pull pump of claim 1 further comprising:
- a container for holding a fluid;
- a neck formed in the container; and
- a liquid passageway formed between the neck of the container and the housing.

5. The pull pump of claim 4 wherein the housing has an outside diameter that is less than the diameter of the inside of the neck of the container.

6. The pull pump of claim 1 wherein at least a portion of the liquid outlet valve is located on the exterior of the piston.

7. The pull pump of claim 1 wherein at least a portion of the liquid outlet valve is located on the interior of the piston.

8. The pull pump of claim 1 wherein the housing includes an opening wherein at least a portion of the opening is located above the top piston, and wherein fluid may flow in and out of the opening to prevent a vacuum from forming above the top of the piston.

9. The pull pump of claim 1 further comprising an air inlet and a one-way air inlet valve, wherein the one-way air inlet valve is located upstream of a mixing chamber and prevents fluid from traveling upstream past the one-way air inlet valve.

10. The pull pump of claim 4 further comprising an air inlet having a connector for releasably connecting the air inlet to an air source.

11. The pull pump of claim 10 further comprising a filter located in the air inlet.

12. The pull pump of claim 11 wherein the filter is selected from a material that continues to function if the filter becomes wet.

13. The pull pump of claim 10 further comprising a dispenser, wherein the dispenser has an air pump secured thereto and the air pump is the air source that releasably connects to the air inlet of the pump.

14. The pull pump of claim 13 wherein the air pump secured to the dispenser includes an air inlet for recharging the air pump and wherein the air inlet is covered by a barrier to prevent moisture or bacteria from entering the air pump.

15. The pull pump of claim 13 wherein the air pump secured to the dispenser contains an additive to inhibit at least one of bacteria growth and mold growth.

16. A refill unit for a dispenser comprising:
- a container for holding a liquid;
- a neck formed in the container;
- a pump housing located at least partially within the neck;
- a piston having a sealing member;
- wherein the sealing member contacts a wall of the pump housing;
- a fluid pathway between the neck of the container and the pump housing;
- a fluid inlet through the sidewall of the pump housing located below the top of the neck of the container;
- a one-way fluid inlet valve located proximate the fluid inlet;
- a fluid outlet including a one-way fluid outlet valve;
- a charge chamber defined at least in part by the one-way fluid inlet valve, the one-way fluid outlet valve, the pump housing and the piston;
- an air inlet;
- a one-way air inlet valve;
- a mixing chamber located downstream of the charge chamber and the one-way air inlet valve;
- an air inlet and a fluid inlet for allowing air and liquid into the mixing chamber; and
- wherein movement of the piston in an upward direction causes fluid to flow into the charge chamber; and movement of the piston in the downward direction causes fluid to be expelled from the charge chamber.

17. The refill unit of claim 16 further comprising a releasable connector secured to the air inlet for connecting to an air source when the refill unit is placed in a dispenser and disconnecting from the air source when the refill unit is removed from the container.

18. The refill unit of claim 16 further comprising a filter in the air inlet.

19. The pump of claim 16 wherein at least a portion of the liquid outlet valve is located on the exterior of the piston.

20. The pump of claim 16 wherein at least a portion of the liquid outlet valve is located on the interior of the piston.

21. A foam pump refill unit comprising:
- a container having a neck;
- the neck further having an inside diameter;
- the inside diameter of the neck having a smaller cross-sectional area than the cross-sectional area of the container;
- a pump housing having an outside diameter;
- the outside diameter of the pump housing having a diameter that is smaller than the inside diameter of the neck to create a fluid flow path therebetween;
- a piston having a piston seal for engaging an inside wall of the pump housing;
- a fluid inlet located in the sidewall of the pump housing to draw in fluid from the fluid flow path;
- a one-way fluid inlet valve;
- a one-way fluid outlet valve;
- a charge chamber defined at least in part by the fluid inlet valve, the one-way fluid outlet valve; the pump housing and a wall of the piston;
- an opening in the wall of the piston to allow fluid to flow from outside of the piston to the interior of the piston;
- a mixing chamber;
- an air inlet;
- a one-way air inlet valve located proximate the air inlet;
- the mixing chamber is located downstream of and in fluid communication with the air inlet and the fluid charge chamber;
- wherein movement of the piston in an upward direction causes fluid to flow into the charge chamber; and movement of the piston in the downward direction causes fluid to be expelled from the charge chamber.

22. The refill unit of claim 21 further comprising a releasable connector secured to the air inlet for connecting to an air source when the refill unit is placed in a dispenser and disconnecting from the air source when the refill unit is removed from the container.

23. The pump of claim 21 further comprising a filter located in the air inlet.

* * * * *